United States Patent [19]

Hubbard

[11] 4,290,233

[45] Sep. 22, 1981

[54] SAFETY DOOR ENTRANCE

[75] Inventor: S. Eugene Hubbard, Niles, Mich.

[73] Assignee: Kawneer Company, Inc., Niles, Mich.

[21] Appl. No.: 70,432

[22] Filed: Aug. 28, 1979

[51] Int. Cl.[3] ..... E06B 7/16

[52] U.S. Cl. ..... 49/383; 52/207

[58] Field of Search ..... 49/383, 485; 160/229, 160/235; 52/207, 206, 210, 397

[56] References Cited

U.S. PATENT DOCUMENTS

| | | | |
|---|---|---|---|
| 1,925,817 | 9/1933 | Plym | 49/383 |
| 2,557,716 | 6/1951 | Allee . | |
| 2,960,733 | 11/1960 | Nida | 49/383 X |
| 3,308,582 | 3/1967 | Bakke | 49/383 |
| 3,319,697 | 5/1967 | Krohn | 49/383 X |
| 3,774,360 | 11/1973 | Hubbard et al. | 52/207 X |
| 3,941,180 | 3/1976 | Thill | 49/383 X |
| 4,157,634 | 6/1979 | Coulston | 49/485 |

FOREIGN PATENT DOCUMENTS

| | | | |
|---|---|---|---|
| 2725159 | 12/1978 | Fed. Rep. of Germany | 49/383 |

*Primary Examiner*—Philip C. Kannan

*Attorney, Agent, or Firm*—Mason, Kolehmainen, Rathburn & Wyss

[57] ABSTRACT

A safety door entrance includes a door mounted for swinging movement on hinges connected to a door jamb and a finger protector for continuously bridging a gap formed between the door heel and adjacent jamb as the door swings open and closed. The protector prevents a person's fingers, toes or other objects from accidentally being inserted in the gap and subject to damage when the door swings closed.

24 Claims, 7 Drawing Figures

Fig. 1
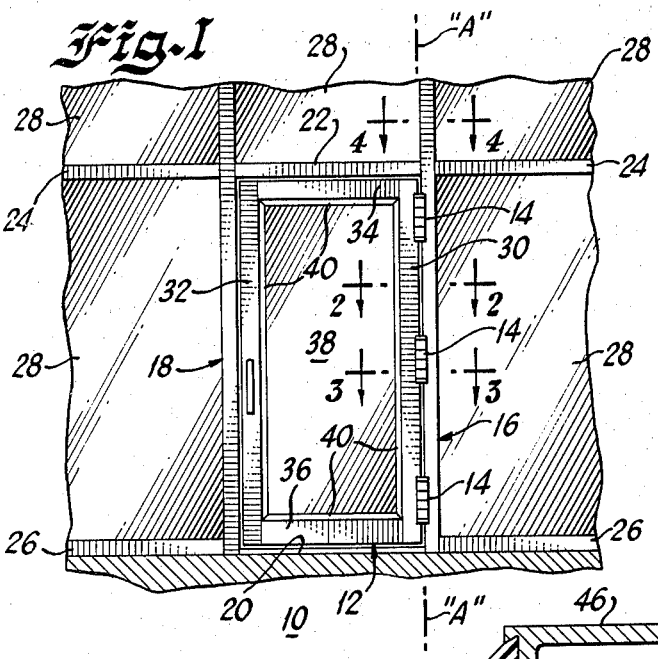
Fig. 2
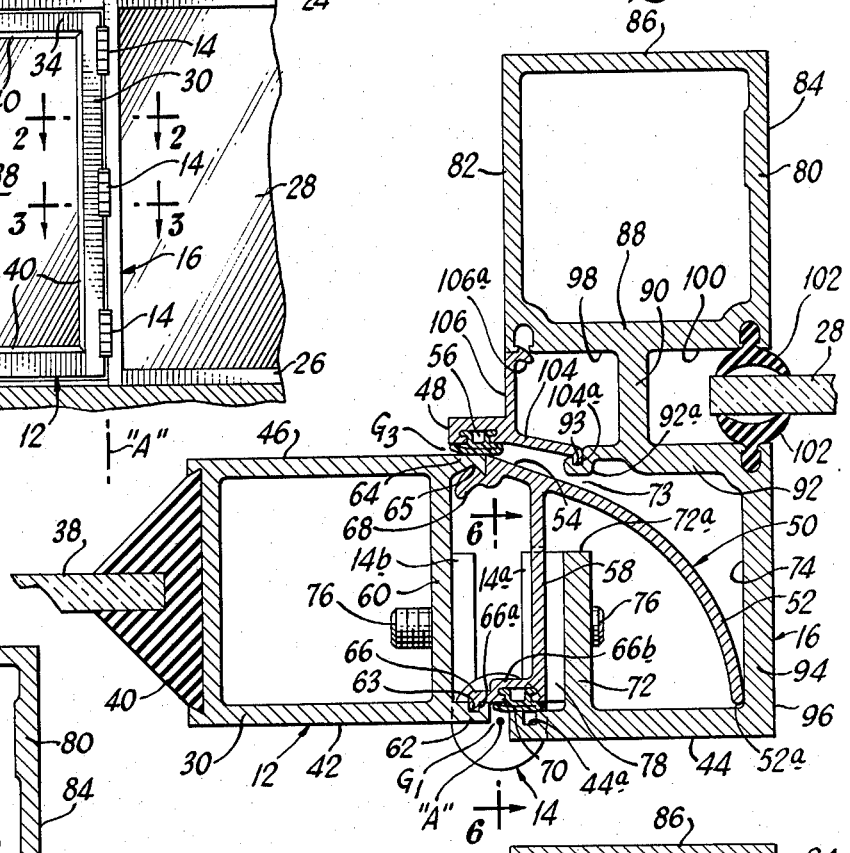
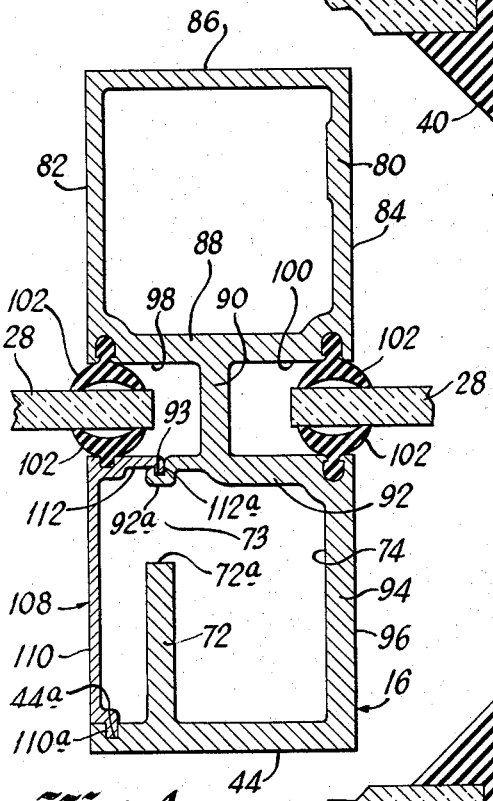
Fig. 4
Fig. 3
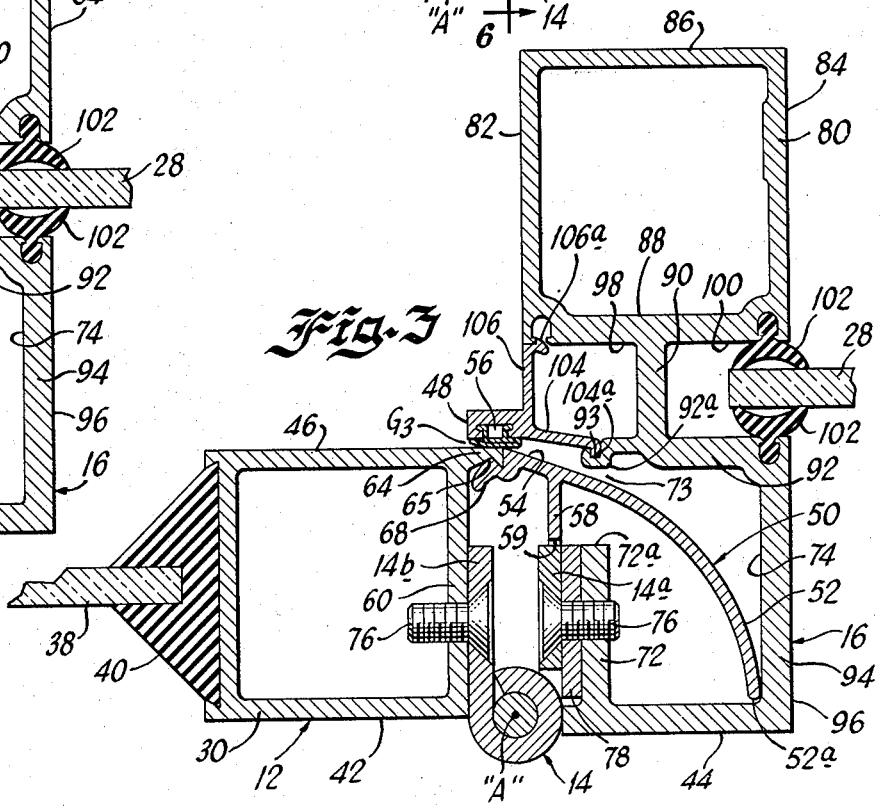

SAFETY DOOR ENTRANCE

BACKGROUND OF THE INVENTION

1. Field of the Invention

The present invention relates to safety door entrances and more particularly a safety device for swinging doors which are hingedly supported from a door jamb or frame element to open and close with respect thereto. The present invention relates to a safety device for discouraging or preventing a person's fingers, toes or other implements from inadvertently being inserted into a gap created between a corner edge of the door and the door jamb while the door is opened, which gap is then closed with crushing force as the door swings closed.

2. Description of the Prior Art

Various systems have been devised for protecting against damage or injury to the fingers, toes or other implements caused from the crushing action of swinging doors or hingedly attached closure members as they swing closed. U.S. Pat. Nos. 3,319,697 and 3,941,180 disclose guards or protecting devices for hinged garage doors and the like. An extruded hinge is shown in the window construction of U.S. Pat. No. 1,925,817 and an interlocking combination door is illustrated in U.S. Pat. No. 2,960,733.

OBJECTS OF THE PRESENT INVENTION

It is an object of the present invention to provide a new and improved safety door entrance and more particularly, to provide a safety device which is highly effective to discourage insertion of fingers, toes or other objects into a gap or opening formed between the heel or corner edge of a door and the abutting door jamb whenever the door is open.

It is another object of the present invention to provide a new and improved safety door entrance of the character described which is suitable for use on doors capable of swinging from a closed position to a full open position aligned at an angle of 90° or more from the closed position.

Still another object of the present invention is to provide a new and improved safety door entrance having a detachable finger protector for continuously closing the gap formed between the heel of the door and the abutting adjacent jamb surface whenever the door is opened.

Yet another object of the present invention is to provide a new and improved safety door entrance having improved weather sealing on both faces of the door.

Still another object of the invention is to provide a new and improved safety door system wherein the hinge(s) supporting the door are covered and enclosed by a finger protecting safety shield.

Yet another object of the present invention is to provide a new and improved finger protector which is detachable and can be readily re-attached and snapped into place.

Another object of the present invention is to provide a new and improved combination of a door hingedly supported on a jamb and finger protector, wherein the jamb is readily adapted to accommodate the finger protector when the door is closed and yet is designed to support a conventional transom panel above the door.

Still another object of the present invention is to provide a new and improved safety door system suitable for use with doors having hollow tubular door stiles.

Yet another object of the present invention is to provide a new and improved safety door entrance which permits the use of simple, butt hinges and permits ready access to the hinges for servicing and maintenance thereof.

Yet another object of the present invention is to provide a new and improved safety door entrance of the character described wherein a detachable finger protector is secured to the butt edge of the door stile adjacent a jamb in a novel manner.

Yet another object of the present invention is to provide a new and improved safety door system which is neat in appearance, relatively simple in construction and operation and is relatively economical in comparison with other types of safety door entrances.

BRIEF SUMMARY OF THE INVENTION

The foregoing and other objects and advantages of the present invention are accomplished in a new and improved safety door entrance comprising, in combination, a door having opposite faces and a hinge stile element along one edge hingedly interconnected to a supporting door jamb element for swinging movement between a closed position wherein an outer door face is generally aligned with an outer face or sight line of the supporting jamb and a fully opened position wherein the outer door face is aligned at an angle of 90° or greater with respect to the outer sight line face. A novel finger protector is detachably secured on the butt edge of the hinge stile of the door and includes a curved wall section which provides for continuous bridging of the gap formed between the butt edge of the door and the adjacent door jamb whenever the door is opened. The door jamb is designed to provide a pocket for receiving the finger protector whenever the door is closed, and a pair of spaced apart weatherstrip are provided for sealing opposite faces of the door and the supporting jamb or frame while the door is both open or closed.

BRIEF DESCRIPTION OF THE DRAWINGS

For a better understanding of the present invention, reference should be had to the following detailed description taken in conjunction with the drawings, in which:

FIG. 1 is an outside, elevational view of a new and improved safety door entrance constructed in accordance with the features of the present invention;

FIG. 2 is an enlarged, horizontal, fragmentary, cross-sectional view taken substantially along lines 2—2 of FIG. 1;

FIG. 3 is an enlarged horizontal, fragmentary, cross-sectional view taken substantially along lines 3—3 of FIG. 1;

FIG. 4 is an enlarged horizontal, fragmentary, cross-sectional view taken substantially along lines 4—4 of FIG. 1;

FIG. 6 is a fragmentary, vertical, cross-sectional view taken substantially along lines 6—6 of FIG. 2.

DESCRIPTION OF THE PREFERRED EMBODIMENTS

Figure 5:
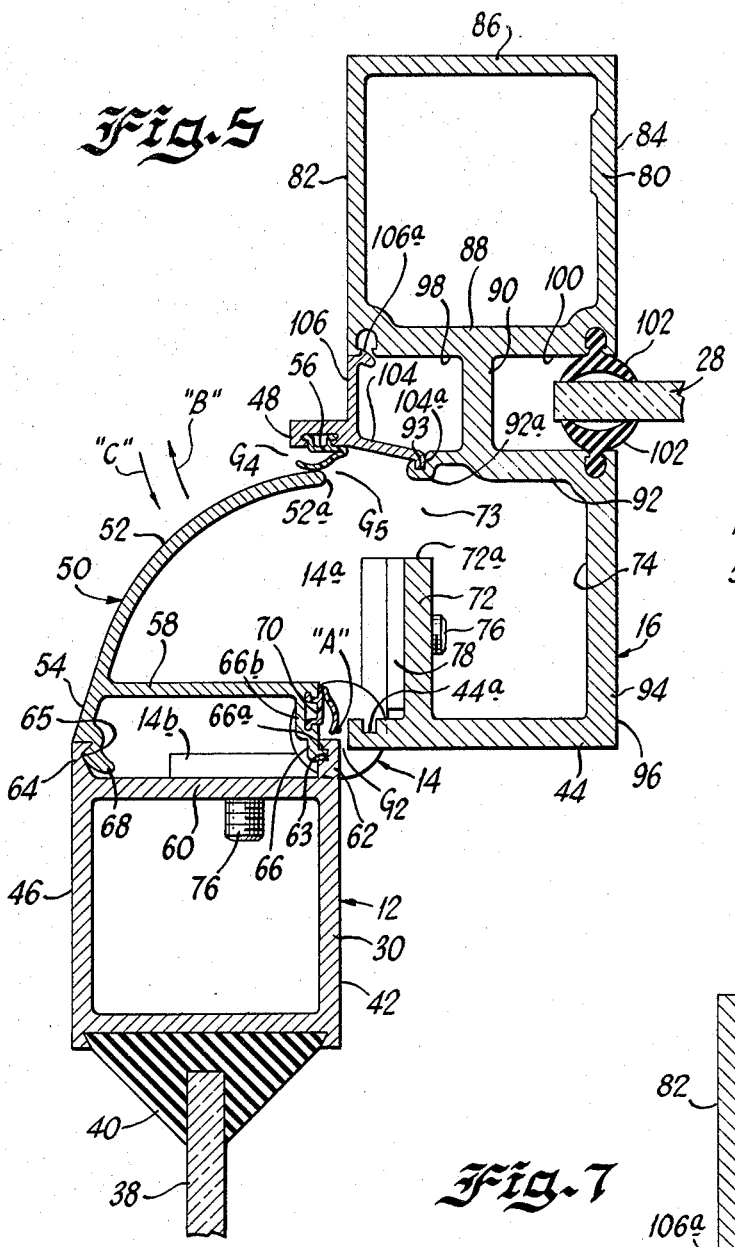
FIG. 5 is a horizontal, cross-sectional view similar to FIG. 2 but illustrating the door in a fully open position.
Figure 5:
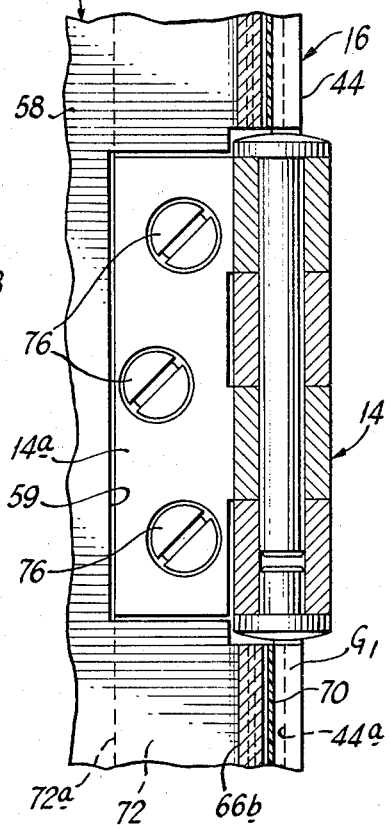

Referring now more particularly to the drawings, in FIG. 1 is illustrated an outside elevational view of a new and improved safety door entrance constructed in accordance with the features of the present invention and referred to generally by the reference numeral 10. The safety door entrance includes a door 12 mounted for swinging movement by a plurality of butt type hinges 14 secured to a door jamb 16 which extends vertically upward beyond the upper edge of the door and defines a side frame member of an entrance door frame. The door frame includes a spaced apart vertical jamb 18 along an opposite stile of the door, a horizontal threshold 20 and a horizontal upper header 22.

The safety door entrance 10 is designed to be architecturally compatible within a curtain wall or store front generally represented in elevation in FIG. 1 and the curtain wall may include in addition to the vertical door jambs 16 and 18 and header 22, one or more intermediate horizontals 24 and lower sills 26 which along with upper headers (not shown) and other verticals parallel of the jambs 16 and 18 (not shown). These members define a plurality of generally rectangular, openings for accommodating large or small panels such as rectangular glazing panels 28.

The door 12 itself includes a pair of vertically extending, hollow, tubular, stiles 30 and 32 which are structurally interconnected adjacent upper and lower end portions by an upper rail 34 and a lower rail 36. The stiles and rails of the door may define one or more rectangular openings in which is mounted a glazing panel 38 and the panel is supported in the structural frame work of the door by suitable glazing stops or strips 40 which may be of a generally triangular-shaped transverse, cross-section having a base portion seated in a groove provided in the tubular stiles and rails as shown in the sectional views.

The door 12 is mounted for outward swinging movement from a closed position (FIG. 2) to a fully open position (FIG. 5) about a vertical hinge axis "A—A" and in the closed position, an outer face 42 of the door is generally parallel with the plane of an outer face 44 of the sight line of the door jambs 16, 18 and the header 22 which provide the surrounding door frame in the curtain wall structure. In the fully open position, as shown in FIG. 5, the outer door face 42 is aligned at an angle of 90° or more with respect to the outer face 44 of the sight line of the surrounding door opening in the curtain wall structure.

Figure 7:
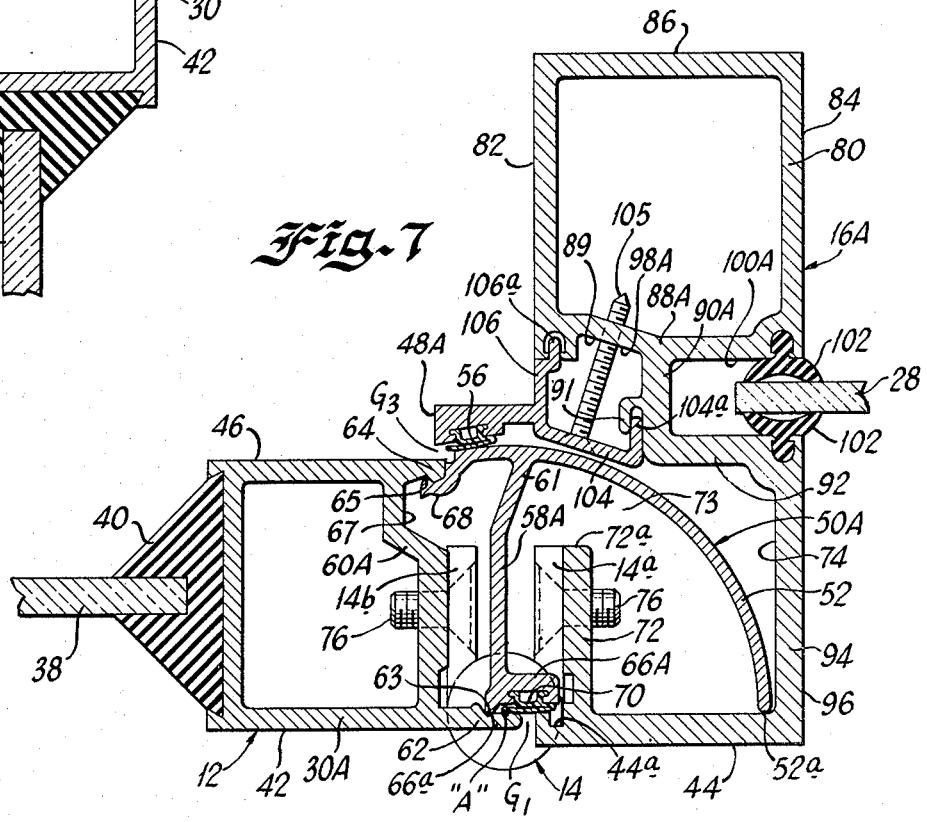
FIG. 7 is an enlarged, fragmentary, horizontal, cross-sectional view similar to FIG. 2 but illustrating an alternative embodiment of the present invention.

The hinge axis "A—A" is aligned to lie on or closely adjacent the outer door face 42 and is generally closely adjacent to the plane 44 of the sight line of the door jambs 16 and 18 and the header 22. Accordingly, only a relatively narrow gap G-1 is formed between adjacent corner edges of the hinge stile 30 and door jamb 16 at the sight line when the door is closed (FIGS. 2 and 7). The gap may be even narrower as illustrated by the spacing gap G-2 of FIG. 5 when the door is fully opened. Consequently, there is a minimal chance of a human finger, toe or other implement being accidentally inserted into the relatively narrow gap at the outer corner edge of the hinge stile of the door.

The same is not true with respect to a relatively narrow gap G-3 between a butt edge corner on an inside door face 46 and an outwardly facing corner of a door stop 48 on the door jamb 16. The narrow gap G-3 which obtains when the door is closed is rapidly enlarged to a much wider opening or gap G-4 (FIG. 5) generally large enough that a person's arm, elbow, finger, hand, toes or other implement could accidentally be inserted into the gap and thereafter suffer damage when the door swings closed.

In accordance with the present invention, a detachable finger protector 50 is detachably secured to the butt edge of the hinge stile 30 of the door which faces the jamb 16 and the finger protector includes a relatively large area, curved wall segment 52 having a rounded outer free edge 52*a*. The wall segment continually spans and closes the large gap G-4 formed whenever the door is open and thereby provides protection against injury. As illustrated in FIG. 5, when the door is fully opened, the rounded outer surface of the curved wall segment 52 on the finger protector provides a protective wall so that only a relatively narrow gap G-5 is permitted between the protector edge 52*a* and the door stop 48. Accordingly, with the protector 50 attached on the edge of the door 12 as illustrated, the chances of "pinching" a finger, tow or nose are minimized as the gaps illustrated as G-3 and G-5 are small enough to prevent even a child's finger from being cut, pinched or bruised as the door swings closed.

In accordance with the present invention, the finger protector 50 includes a planar wall segment 54 integral with the curved wall segment 52 and extending tangent to the surface of the curved wall segment which comprises a portion of a cylindrical surface having an axis common with the hinge axis "A—A". The planar wall segment is sloped away from the door stop 48 and an inside weatherstrip 56 mounted in a slot thereof so that when the door 12 is initially opened, the surface of the planar wall segment of the protector moves outwardly away from the weatherstrip thereby reducing the amount of sealing compression therewith.

The weatherstrip 56 is preferably of the type shown and described in U.S. Pat. No. 4,157,634 issued June 12, 1979, which patent is assigned to the same Assignee as the present application, and includes a deflectable outer sealing element formed of flexible material and adapted to bear and seal tightly against the inside door surface 46 and a portion of the planar wall segment 54 of the finger protector when the door is closed as shown in FIG. 2. As the door is pivoted from the closed position toward the open position, the outer surface of the planar wall segment 54 moves in front of, but outwardly away from the weatherstrip 56 and thus, friction between the surface of the finger protector and weatherstrip is reduced so as not to inhibit opening of the door in any appreciable degree. After the door is opened far enough so that the curved wall segment 52 is positioned in front of the weatherstrip 56 only a very light pressure contact is provided between the surface of the curved wall segment and the flexible sealing element of the weatherstrip as shown in FIG. 5.

The finger protector 50 includes an integral inwardly extending web or base 58 aligned in parallel with a facing wall segment 60 of the hinge stile 30 of the door. The wall segment 60 forms the bottom wall of a channel or groove facing the web 58 and a pair of opposite sidewalls of the groove are formed by a pair of opposite spaced apart ribs 62 and 64, respectively, which project beyond the wall segment 60 to engage ribs 66 and 68, respectively, of the finger protector 50. The rib 62 adjacent the outer face 42 of the door stile 30 is provided with a groove 63 on an inside face in order to receive a hook-like end portion or ridge 66*a* along the free edge of a rib 66 on the finger protector. The outer ridge 66*a* seats in the groove 63 to provide interlocking engagement between the finger protector and the door stile 30 so that the finger protector can be snapped into place as shown by subsequent rocking action. The inside surface of the inside rib 64 of the door stile is formed with a relatively large V-shaped groove 65 in order to provide engagement with the rib 68 of the finger protector which is flexible to snap into the groove and which is provided with a cross-sectional profile as illustrated. Urging finger protector 50 toward the door edge is effective to snap the ribs into interlocking engagement with the door stile as illustrated.

The finger protector may be readily detached when desired while the door is open (FIG. 5) by pulling the finger protector 50 away from the edge of the door stile 30 generally in the direction indicated by the arrow "B" (FIG. 5). When this occurs, the rib 68 is deflected inwardly until it clears the groove 65 on the rib 64 of the door stile and then the finger protector is moved so that the ridge 66*a* can be disengaged from the opposite groove 63 on the rib 62 of the door stile. To reassemble the finger protector 50 onto the door stile 30, the finger protector is aligned so that the ridge 66*a* is first engaged in the groove 63 and then is pivoted inwardly as indicated by the arrow "C" about the axis of this engagement line until the rib 68 is deflected inwardly momentarily and then snaps back or deflects outwardly again to seat against the surface of the groove 65 in the rib 64. In this manner, the finger protector 50 can be easily snapped into place and is retained in place by the engaging pairs of ribs 62 and 66 adjacent the outer surface of the door and the engaging pair of ribs 64 and 68 adjacent the inside surface of the door.

The rib 66 is also provided with a thickened body portion 66*b* having an outwardly facing groove therein to accommodate an outside weatherstrip 70 of the same configuration as the inside weatherstrip 56 and the outer weatherstrip provides a seal adjacent the outside face 42 of the door when the door is closed as shown in FIG. 2. The deflectable outer sealing element of the outside weatherstrip 70 is adapted to bear against an inwardly facing grooved surface on the inside face of the sight line wall segment 44 of the door jamb 16.

In accordance with the invention, the door jamb 16 is formed with an inwardly extending, relatively thick, integrally formed internal rib 72 which defines along a free edge 72*a* thereof, the outside edge of an elongated opening 73 providing access to a relatively large, internal jamb pocket 74 provided for accommodating the curved wall segment 52 of the finger protector 50 when the door 12 is in a closed position as shown in FIGS. 2 and 3. The internal rib 72 also provides support for hinge leaves 14*a* of the butt hinges 14 which are secured thereto by relatively short cap screws 76 having countersink heads. Opposite hinge leaves 14*b* are similarly secured to the wall segment 60 of the hinge stile 30 of the door with cap screws. Additionally, the integral rib 72 is strengthened by a hinge support strip 78 formed of steel and provided with drilled and tapped openings for accommodating the shanks of the cap screws 76. It should be noted from FIGS. 2 and 3, that the web 58 of the finger protector 50 is aligned to lie on a common plane with the leaves 14*a* of the hinges 14 and the web is notched out at appropriate locations designated as 59 in FIG. 6, to accommodate the hinge leaves. This notched engagement provides a means for securing the finger protector 50 against relative longitudinal movement with respect to the door jamb 16 and in particular, the internal rib 72 thereof.

The door jamb or frame member 16 is of a generally rectangular, transverse, cross-section and includes a hollow, tubular, square shaped, inside section 80 with a pair of opposite, jamb surfaces defining sidewalls 82 and 84, an inside sight line wall 86 and an intermediate web or transverse mid wall 88. The web 88 is integrally joined by a relatively thick web 90 extending transverse thereto, to an intermediate wall segment or web 92 of a generally square shaped, hollow, outer wall section 94 which provides the internal jamb pocket 74. The outer wall section of the jamb 16 is substantially tubular in transverse cross-section except for the pocket opening 73 and includes a jamb surface side wall 96 on one side aligned in parallel with the jamb side wall 84. The outside sight line, wall 44 is parallel of the wall 86 and the internal web 72 is parallel but offset from the wall 82. Transverse walls 88 and 92 and the web 90 form a pair of back-to-back glazing pockets 98 and 100 (FIG. 4) and these pockets are adapted to receive marginal edge portions of respective glazing panels 28 which are secured in place between the opposite side walls of the pockets by glazing wedges 102.

An opposite edge of the jamb pocket opening 73 formed in the outer sectional portion 94 of the jamb 16 is provided by a relatively thinner rib portion 92*a* along the web or wall 92 and the rib portion projects beyond the main body of the web 90 that forms the bottom wall between the back-to-back, glazing pockets 98 and 100. The thin rib portion 92*a* is formed with a longitudinally extending groove 93 adapted to accommodate an interlocking rib 104*a* along a free edge of one leg of the door stop 48. The stop includes another leg 106 provided with a rib 106*a* adapted to snap fit in a groove provided for the glazing wedge in the wall of the glazing pocket 98. The door stop is detachably secured to the jamb 16 and may be readily snapped into the position as shown along with the inside weatherstrip element 56 carried thereby.

In accordance with the present invention, above the door 12, a transom may be provided in the curtain wall or store front and an upwardly continuing portion of the door jamb 16 serving as a side frame member thereof, as illustrated in FIGS. 1 and 4. In order to form a jamb surface aligned with the inside jamb wall 82 of the inside tubular section of the jamb, a cover element 108 is adapted to snap in place and cover over the pocket opening 73. The cover also forms one side wall for the glazing pocket 98 for supporting the outside glazing wedge 102. The cover has an angle-shaped transverse cross-section and includes a jamb leg 110 having an offset rib 110*a* along the free edge thereof adapted to seat in the groove 44*a* provided on the inside surface of the outside, sight line wall 44. The cover includes another leg 112 at right angles to the leg 110 having a rib 112*a* adapted to snap into the groove 93 on the intermediate wall portion or web 92*a* to provide a side wall for the glazing pocket 98 to support the glazing wedge 102 against the outside surface of the glazing panel 28.

From the foregoing it will be seen that the door 12, the jamb 16 and finger protector 50 provide a novel safety door entrance 10 which is compatible with most curtain wall and store front framing systems in appearance. The door and curtain wall frame members are preferably formed of extruded aluminum sections and are especially designed for easy and rapid fabrication. The finger protector 50 is snap fitted into the edge of the door and when in place, eliminates or greatly reduces the hazard or danger of a finger, toe or other elements being pinched, bruised, or cut during swinging movement of the door. A pair of inside and outside weatherstrip 56 and 70 provide for excellent weather sealing against air infiltration or water leakage. The finger protector is detachable to provide access to the hinges 14 for service as necessary, yet overall, the safety door entrance provides good security against unauthorized entrance from the outside when locked.

Referring now to FIG. 7, an alternate embodiment is shown and identical reference numerals are used to describe parts or components similar or identical to those of the previously described embodiment. Those elements differing significantly in the alternate embodiment are provided with reference numbers having a suffix "A" to distinguish them from the prior counterparts.

The embodiment of the invention shown in FIG. 7 is generally similar in operation and function to the embodiment of FIGS. 1 through 6 except that a modified finger protector 50A does not include a planar wall segment and the outer surface of the large curved segment 52 thereof conforms entirely to a segment of cylindrical surface having an axis of generation coincident with the hinge axis "A—A". A modified web 58A is provided with an angularly offset portion 61 integrally joined with the inside of the curved segment 52 and a wall 60A of the hinge stile 30A of the door 12A is formed with a recessed offset portion 67 facing the offset portion 61 in order to accommodate a rib 68 of the protector. A rib section 66A along the opposite edge of the web 58A extends toward the internal rib 72 of the jamb 16A and has an outwardly facing groove, provided therein for supporting the outside weatherstrip 70. The outside weatherstrip bears against and seals between the inside surface of the outer sight line wall 44 and the adjacent inside surface of a rib portion 62 on the door stile 30A across the gap G-1 as illustrated.

A modified form of door stop 48A is provided in a glazing pocket 98A and the pocket includes an angularly offset side wall portion 89 for receiving a self-tapping fastener 105 for holding the door stop in place. One leg 104 of the modified door stop includes a rib 104*a* at the outer free edge which is seated within a pocket formed by a rib 91 on the modified web 90A of the jamb member 16A. The modified finger protector 50A thus presents a slightly larger diameter, continuous cylindrical surface segment 52 which bears against the deflectable sealing element of the inside weatherstrip 56 with a substantially even or constant amount of sealing force throughout the entire opening or swinging movement of the door between its closed and open positions.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. In combination, a door having opposite faces and a hinge stile element along one edge thereof, a door jamb element adjacent said hinge stile element, and hinge means interconnecting said elements for supporting said door for pivotal movement about a hinge axis parallel of said elements to swing between a closed and an open position wherein a corner edge of said door on one face thereof moves between corresponding positions closely adjacent said jamb element and spaced apart from said jamb forming a gap between said corner and jamb element, a finger protector secured on one of said elements to extend between facing portions thereof including a curved wall surface for continuously bridging said gap while said door swings between said open and closed positions, the other of said elements including a pocket for receiving said finger protector when said door is closed, and a pair of spaced apart weatherstrip means between said elements, one of said weatherstrip means mounted to provide a seal between said curved wall surface of said finger protector and said other element and the other of said weatherstrip means mounted to provide a seal between said elements adjacent a door face opposite from the door face adjacent said curved wall surface of said finger protector.

2. The combination of claim 1 wherein said finger protector includes a wall surface adjoining said curved wall surface sloped to move away from said one weatherstrip means as said door swings from said closed position toward said open position.

3. The combination of claim 1 wherein said curved wall surface of said finger protector comprises an arcuate portion of a cylindrical surface coaxially aligned with said hinge axis.

4. The combination of claim 1 wherein said hinge means includes at least one pair of pivotally interconnected hinge leafs connected to said respective elements and extending between facing portions thereof.

5. The combination of claim 4 wherein said curved wall surface of said finger protector is in enclosing covering relation over said hinge leafs.

6. The combination of claim 4 wherein said finger protector includes a portion notched to accommodate at least one hinge leaf and prevent longitudinal movement with respect thereto.

7. The combination of claim 1 wherein said finger protector and said one of said elements include connector means for detachably mounting said finger protector on said one element.

8. The combination of claim 7 wherein said connector means includes at least one deflectable rib and groove means for receiving said rib.

9. The combination of claim 8 wherein said finger protector includes a pair of said deflectable ribs and said one element includes said groove means.

10. The combination of claim 9 wherein said groove means is formed on said hinge stile.

11. The combination of claim 9 wherein said hinge stile of said door comprises a tubular member having a wall forming a bottom of said groove facing said jamb element pocket, said stile includes a pair of opposite face walls having rib portions projecting beyond said bottom wall of said groove toward said jamb and said ribs of said finger protector engaging said rib portions to secure said protector on said door.

12. The combination of claim 11 wherein said rib portions and said ribs are shaped so that said finger protector is snapped into secured engagement on said door stile by deflection of said ribs or rib portion when said protector is forced toward said bottom wall.

13. The combination of claim 11 wherein said finger protector includes a wall portion facing said bottom wall when said door is closed with one of said ribs formed along a free edge thereof.

14. The combination of claim 13 wherein said other rib of said finger protector is formed along a free edge of said curved wall surface.

15. The combination of claim 1 wherein said pocket is formed in said door jamb element and includes a wall portion for supporting said hinge means.

16. The combination of claim 15 wherein said wall portion comprises an integrally formed, longitudinally extending, internal rib of said door jamb element parallel of a jamb face thereof.

17. The combination of claim 16 wherein a free edge of said internal rib defines an edge of an opening of said pocket for receiving said curved wall portion of said finger protector.

18. The combination of claim 17 wherein an opposite edge of said opening is defined by said one weatherstrip means.

19. The combination of claim 18 including a door stop detachably secured on said jamb element and supporting said one weatherstrip means.

20. The combination of claim 15 wherein said door jamb element includes a longitudinally extending flange aligned parallel of said opposite door face when said door is closed, said other weatherstrip means forming a seal between said door and said flange.

21. The combination of claim 20 wherein said other weatherstrip means is detachably mounted on said finger protector.

22. The combination of claim 17 wherein said jamb element extends longitudinally beyond said door and including a cover element adapted for attachment to said jamb element along said longitudinally extending portion forming a closure for said pocket opening and providing a jamb face surface.

23. The combination of claim 22 wherein said cover element and jamb element include interconnecting means cooperating to secure said cover element to said jamb element along opposite edge portions of said cover element.

24. The combination of claim 23 wherein said cover element and jamb element include facing wall portions forming a glazing pocket for receiving an edge portion of a glazing panel or the like aligned in parallel with said door in a closed position.

* * * * *